US006787722B2

(12) United States Patent
Tsutsui

(10) Patent No.: US 6,787,722 B2
(45) Date of Patent: Sep. 7, 2004

(54) CONTACT MECHANISM

(75) Inventor: Takaki Tsutsui, Tokyo (JP)

(73) Assignee: Mitsumi Electric Co., Ltd., Chofu (JP)

( * ) Notice: Subject to any disclaimer, the term of this patent is extended or adjusted under 35 U.S.C. 154(b) by 27 days.

(21) Appl. No.: 10/310,104

(22) Filed: Dec. 4, 2002

(65) Prior Publication Data

US 2003/0232518 A1 Dec. 18, 2003

(30) Foreign Application Priority Data

Jun. 18, 2002 (JP) ..... 2002-177463

(51) Int. Cl.[7] ..... H01H 13/70
(52) U.S. Cl. ..... 200/512
(58) Field of Search ..... 200/512, 5 A, 200/517, 514

(56) References Cited

U.S. PATENT DOCUMENTS 4,243,861 A * 1/1981 Strandwitz ..... 200/512

* cited by examiner

*Primary Examiner*—Neil Abrams
(74) *Attorney, Agent, or Firm*—Darby & Darby

(57) ABSTRACT

The present invention provides a contact mechanism which comprises a fixed contact and a movable contact. The fixed contact is formed by arranging two terminals having a plurality of parallel contacts so that the contacts are disposed in an alternating manner and at a predetermined pattern pitch. The movable contact is disposed above the contacts of the fixed contact to be able to connect with the contacts of the fixed contact. The pattern pitch of the contacts is set within a range of 0.4 mm to 0.8 mm. The present invention provides a durable contact mechanism having stable output levels.

6 Claims, 6 Drawing Sheets

FIG. 1a
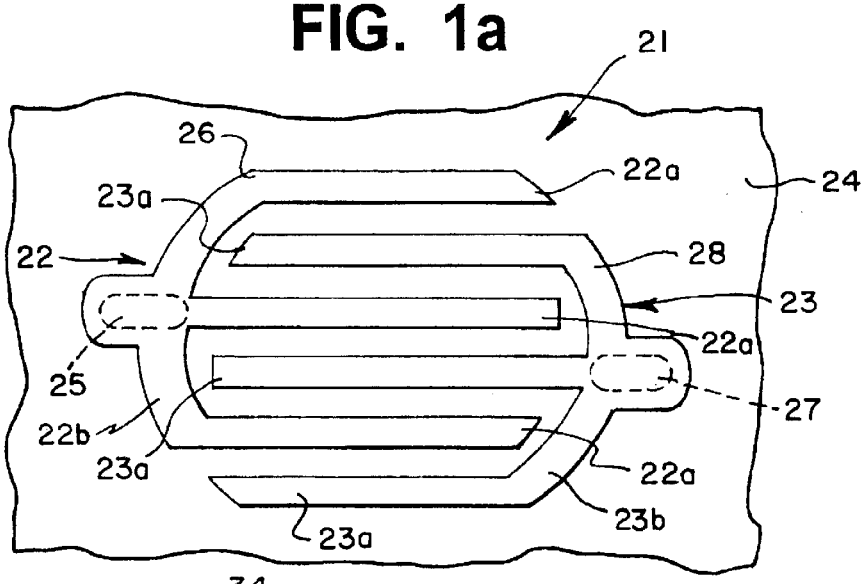
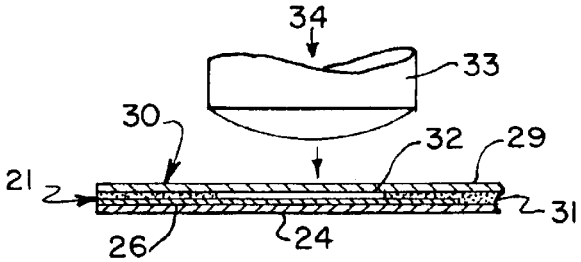
FIG. 1b
FIG. 3
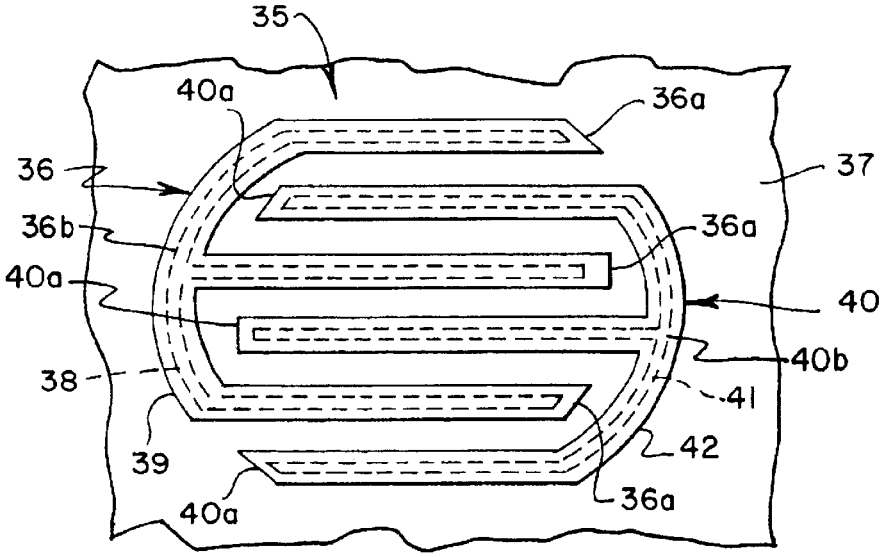

CONTACT MECHANISM

FIELD OF THE INVENTION

The present invention relates to a contact mechanism used in game devices and the like in which a fixed contact is arranged on a substrate having a predetermined pattern pitch. The contact mechanism is durable, and the output from the contact mechanism is stable.

BACKGROUND OF THE INVENTION

A conventional contact mechanism is shown in FIGS. 4(*a*), 4(*b*), 5(*a*), and 5(*b*). FIG. 4(*a*) shows a fixed contact 1 of a contact mechanism 14. The fixed contact 1 is formed from an approximately E-shaped terminal 2 equipped with a plurality of parallel contacts 2*a* and a contact connecting portion 2*b* and an approximately reverse E-shaped terminal 3 equipped with a plurality of parallel contacts 3*a* and a contact connecting portion 3*b*. Terminals 2, 3 are arranged on a substrate 4 so that each of contacts 2*a* are formed adjacent to and alternate with each of contacts 3*a*. The alternating contacts 2*a*, 3*a* have a predetermined pattern pitch.

Terminal 2 is formed in an approximate "E" shape with a copper foil pattern 5 on the substrate 4. Carbon 6 is applied to cover the copper foil pattern 5 in the approximately E-shaped pattern. Terminal 3 is formed in an approximate reversed "E" shape with a copper foil pattern 7 on the substrate 4. Carbon 8 is applied to cover the copper foil pattern 7 in the approximately reversed E-shaped pattern.

Contacts 2*a*, 3*a* are disposed in an alternating manner and are arranged with a pattern pitch of approximately 0.8 mm. The width of each of contacts 2*a*, 3*a* is approximately 0.8 mm, and the distance separating adjacent contacts 2*a*, 3*a* is approximately 0.8 mm.

A movable contact 10 is formed from a pressure-sensitive element 9 which is adhered to the fixed contact 1 using an adhesive 11. The adhesive 11 is applied in a predetermined pattern as shown in FIG. 4(*b*).

The pattern of the adhesive 11 results in the formation of spaces 12 where the adhesive 11 is not applied at predetermined positions between the movable contact 10 and the alternating contacts 2*a*, 3*a* of the fixed contact 1. The spaces 12 separate the alternating contacts 2*a*, 3*a* of the fixed contact 1 from the movable contact 10 to allow contact. Thus, the adhesive 11 serves as a spacer.

A rubber piece 13 is disposed above the movable contact 10 so that it can contact and move away from the movable contact 10. The rubber piece 13, the movable contact 10, and the fixed contact 1 form the contact mechanism 14.

The bottom end of the rubber piece 13 of the contact mechanism 14 pushes down on the pressure-sensitive element 9 of the movable contact 10 above the space 12 when the rubber piece 13 is pressed downward. The pressure-sensitive element 9 contacts the fixed contact 1 and generates an output. The downward force on the pressure-sensitive element 9 and the output level from the contact mechanism 14 increase as the rubber piece 13 is pushed down.

FIG. 5(*a*) is a graph illustrating the relationship between the level of the output and the downward force on the rubber piece 13 after 2 million operations of the contact mechanism 14. The graph shows measurements from a sampling of 18 contact mechanisms. The results indicate that the relationship between the output level and the downward force varies after 2 million applications. The output level is unstable, and the error in the output level increases slightly with each sample.

FIG. 5(*b*) is a graph illustrating the relationship between the level of the output and the downward force on the rubber piece 13 after 10 million operations of the contact mechanism 14. The relationship between the output level and the downward force is considerably less stable than the relationship shown in FIG. 5(*a*). The output is extremely unstable and the output error is higher for each sample as the number of applications increases.

The results in FIGS. 5(*a*) and 5(*b*) indicate that the output from the contact mechanism 14 will vary even when the usage count is low, and the output level varies depending on the individual sample. Furthermore, the stability of the output level is severely degraded, and the contact mechanism shows inferior durability as the usage count increases. The variation of the overall output level and between the output levels of each sample are high.

A possible cause for error is the wide spacing of the pattern pitch of the contacts 2*a*, 3*a* of the fixed contact 1. The contact position between the movable contact 10 and the contacts 2*a*, 3*a* of the fixed contact 1 is misaligned, and this misalignment leads to instability and errors in the output levels. Another possible cause for error is the repeated use of the contact mechanism 14. The substrate 4 under repeated use becomes damaged near the ends of the copper foil patterns 5, 7 since the ends of the copper foil patterns 5, 7 are pressed against the carbons 6, 8. The repeated use of the contact mechanism 14 increases the error in the output levels.

OBJECTS AND SUMMARY OF THE INVENTION

The present invention provides a durable contact mechanism having stable output levels. The contact mechanism comprises a fixed contact and a movable contact. The fixed contact is formed by arranging two terminals having a plurality of parallel contacts so that the contacts are disposed in an alternating manner and at a predetermined pattern pitch. The movable contact is disposed above the contacts of the fixed contact to be able to connect with the contacts of the fixed contact. The pattern pitch of the contacts is set within a range of 0.4 mm–0.8 mm. The contacts of the fixed contact can be made of carbon formed on the substrate. The contacts of the fixed contact can be formed from carbon covering a copper foil pattern formed on the substrate. Furthermore, the movable contact can be a pressure-sensitive element.

The objects, features, and advantages of the present invention will become apparent from the following description read in conjunction with the accompanying drawings in which like reference numerals designate the same elements.

BRIEF DESCRIPTION OF THE DRAWINGS

FIG. 1(*a*) is a plan drawing of a fixed contact formed on a substrate according to the present invention.

FIG. 1(*b*) is a partially cut-away front-view drawing of a contact mechanism according to the present invention.

FIG. 2(*b*) is a graph illustrating the relationship between downward force and output level for a fixed contact of FIG. 1 after ten million operations.

FIG. 3 is a plan drawing of a fixed contact formed on a substrate according to an embodiment of the present invention.

FIG. 4(*b*) is a partially cut-away front-view drawing of a conventional contact mechanism.

FIG. 5(*b*) is a graph showing the relationship between downward force and output level for a fixed contact of FIG. 4 after ten million operations.

LIST OF DESIGNATORS

Figure 2A:
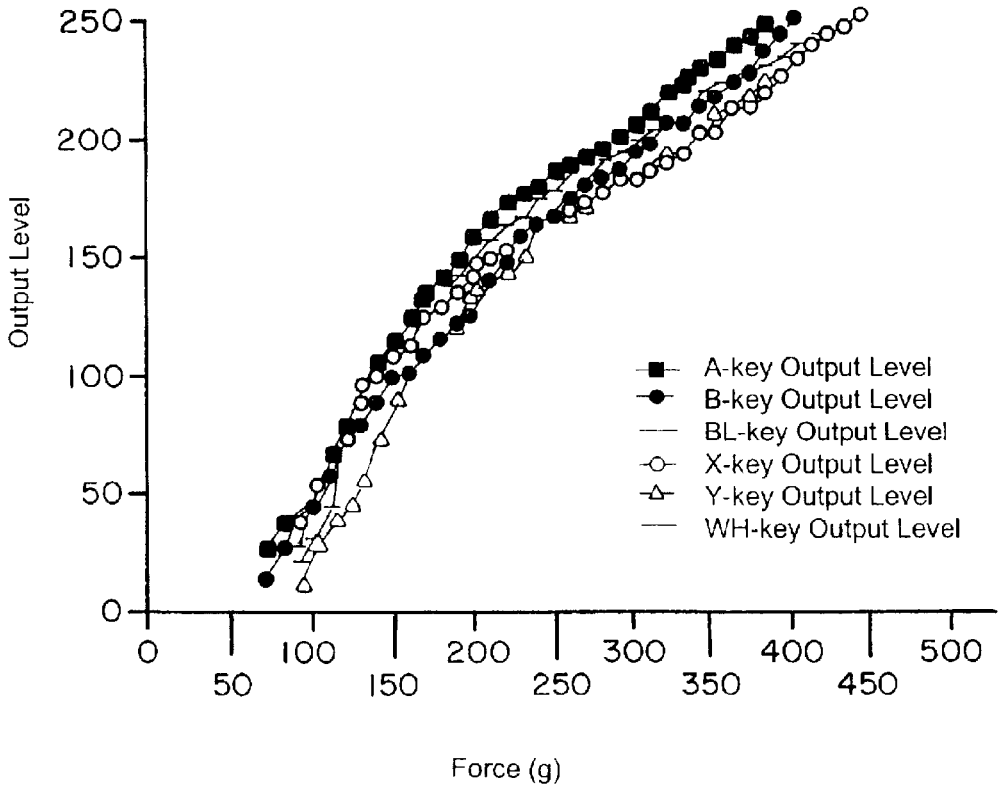
FIG. 2(*a*) is a graph illustrating the relationship between downward force and output level for a fixed contact of FIG. 1 after three million operations.

1, 21, 35: fixed contact
2, 3, 22, 23, 36, 40: terminal
2*a*, 3*a*, 22*a*, 23*a*, 36*a*, 40*a*: contact
2*b*, 3*b*, 22*b*, 23*b*, 36*b*, 40*b*: contact connecting portion.
4, 24, 37: substrate
5, 7, 38, 41: copper foil pattern
6, 8, 26, 28, 39, 42: carbon
9, 29: pressure-sensitive element
10, 30: movable contact
11, 31: adhesive
12, 32: space
13, 33: rubber piece
14, 34: contact mechanism
25, 27: connecting section

DETAILED DESCRIPTION OF THE PREFERRED EMBODIMENTS

A fixed contact 21 of a contact mechanism 34 is formed from an approximately E-shaped terminal 22 and an approximately reverse E-shaped terminal 23 as shown in FIG. 1(*a*). Terminal 22 is equipped with a plurality of parallel contacts 22*a* and a contact connecting portion 22*b*, and terminal 23 is equipped with a plurality of parallel contacts 23*a* and a contact connecting portion 23*b*. Terminals 22, 23 are disposed on the substrate 24 so that the contacts 22*a*, 23*a* are arranged in an alternating manner at a predetermined pattern pitch.

A connecting section 25 made of copper foil is disposed in terminal 22 on the substrate 24. Carbon 26 is applied in an approximately E-shaped pattern onto the connecting section 25 and the substrate 24. A connecting section 27 made of copper foil is formed in terminal 23 on the substrate 24. Carbon 28 is applied in an approximately reverse E-shaped pattern on the connecting section 27 and the substrate 24.

The optimal pattern pitch for the alternating contacts 22*a*, 23*a* is 0.5 mm. However, the pitch can be within the range of 0.4 mm to 0.8 mm. The width of each of the contacts 22*a*, 23*a* is approximately 0.5 mm, and the distance separating adjacent contacts 22*a*, 23*a* is approximately 0.5 mm.

The movable contact 30 includes the pressure-sensitive element 29 and is adhered to the fixed contact 21 by an adhesive 31 as shown in FIG. 1(*b*). The adhesive 31 is applied in a predetermined pattern.

The pattern of the adhesive 31 results in the formation of spaces 32 where the adhesive 31 is not applied at predetermined positions between the movable contact 30 and the contacts 22*a*, 23*a* of the fixed contact 21. The spaces 32 separate the contacts 22*a*, 23*a* of the fixed contact 21 from the movable contact 30 to allow contact. Thus, the adhesive 31 serves as a spacer.

A rubber piece 33 is disposed above the movable contact 30 so that it can contact and move away from the movable contact 30. The rubber piece 33, the movable contact 30, and the fixed contact 21 form the contact mechanism 34.

The bottom end of the rubber piece 33 pushes down on the pressure-sensitive element 29 above the space 32 when the rubber piece 33 is pressed downward. The pressure-sensitive element 29 contacts the carbon 26, 28 of the contacts 22*a*, 23*a* of the fixed contact 21 and generates an output. The downward force on the pressure-sensitive element 29 and the output level from the contact mechanism 34 increase as the rubber piece 33 is pressed down further.

Figure 2B:
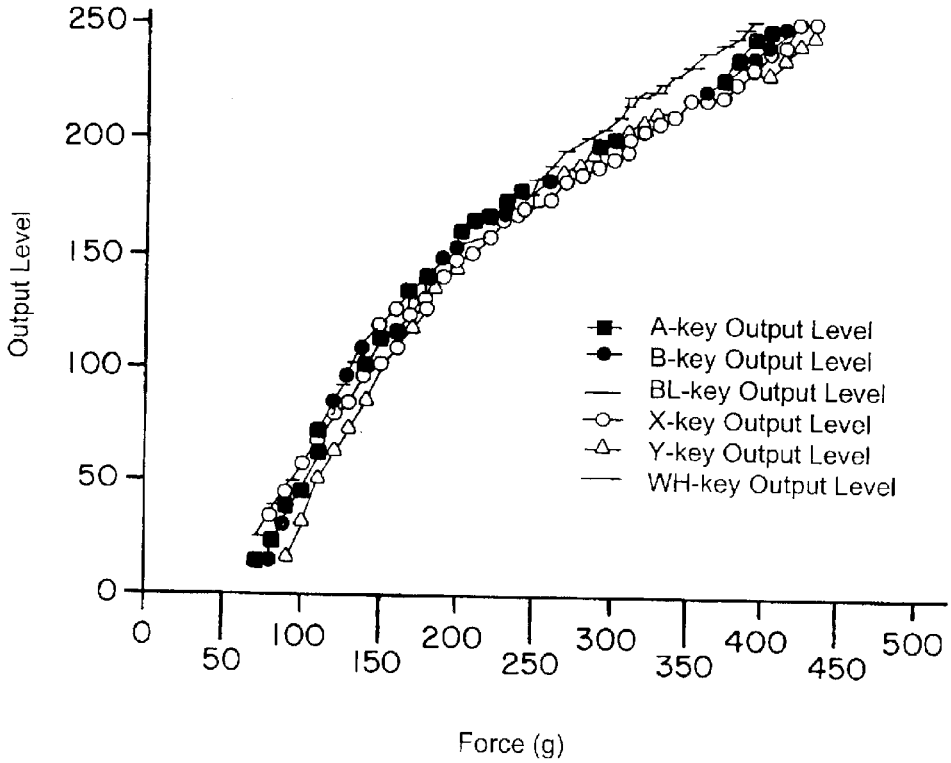

FIG. 2(*a*) is a graph illustrating the relationship between the output level and the downward force on the rubber piece 33 after approximately 3 million operations. The graph shows measurements from a sampling of six contact mechanisms. The ratio of the output level to the downward force shows negligible variation and negligible output error in the results for the individual samples.

FIG. 2(*b*) is a graph illustrating the relationship between the output level and the downward force on the rubber piece 33 after approximately 10 million operations. The graph shows measurements from a sampling of six contact mechanisms. The ratio of output level to the downward force shows negligible variation and negligible output error in the results for the individual samples, which is similar to FIG. 2(*a*).

The results shown in FIGS. 2(*a*) and 2(*b*) show that the contact mechanism 14 can provide stable output levels after a large number of operations. There is almost no variation in the output levels when comparing output levels in the individual samples. Therefore, the contact mechanism 14 provides reliable output levels and is durable.

The movable contact 30 in the contact mechanism 34 can include the pressure-sensitive element 29, but it is possible to use other types of contacts in the movable contact 30.

Figure 4A:
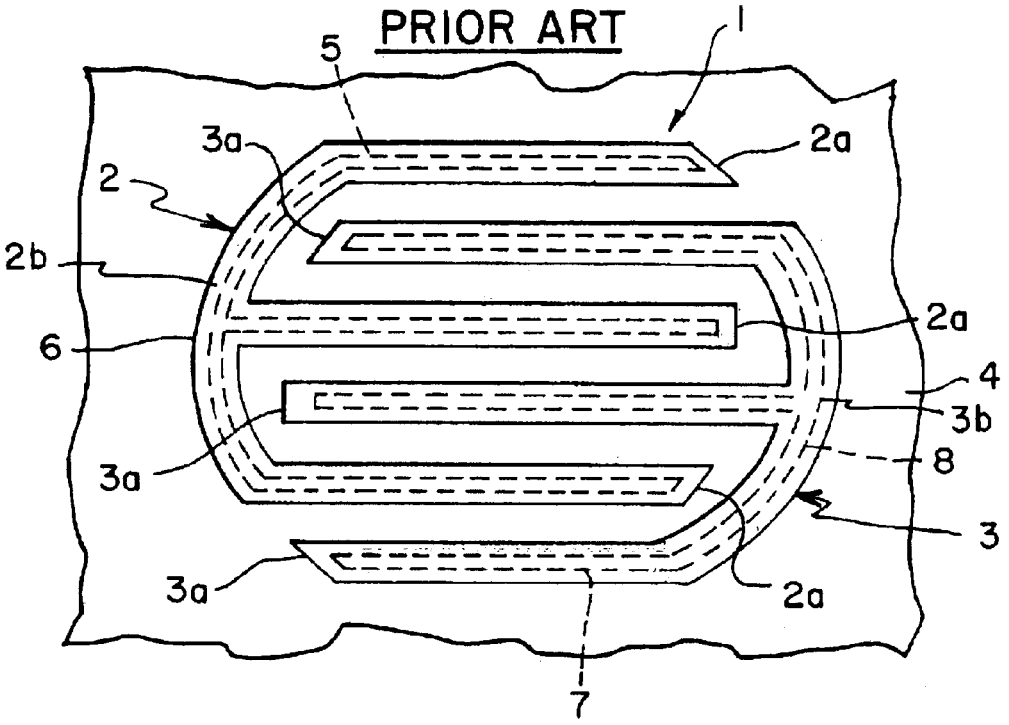
FIG. 4a PRIOR ART
FIG. 4(*a*) is a plan drawing of a fixed contact formed on a substrate of a conventional contact mechanism.
Figure 4B:
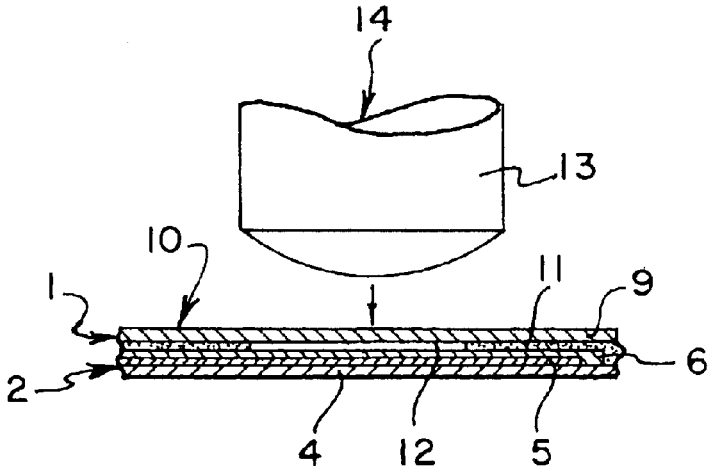
FIG. 4b PRIOR ART
Figure 5A:
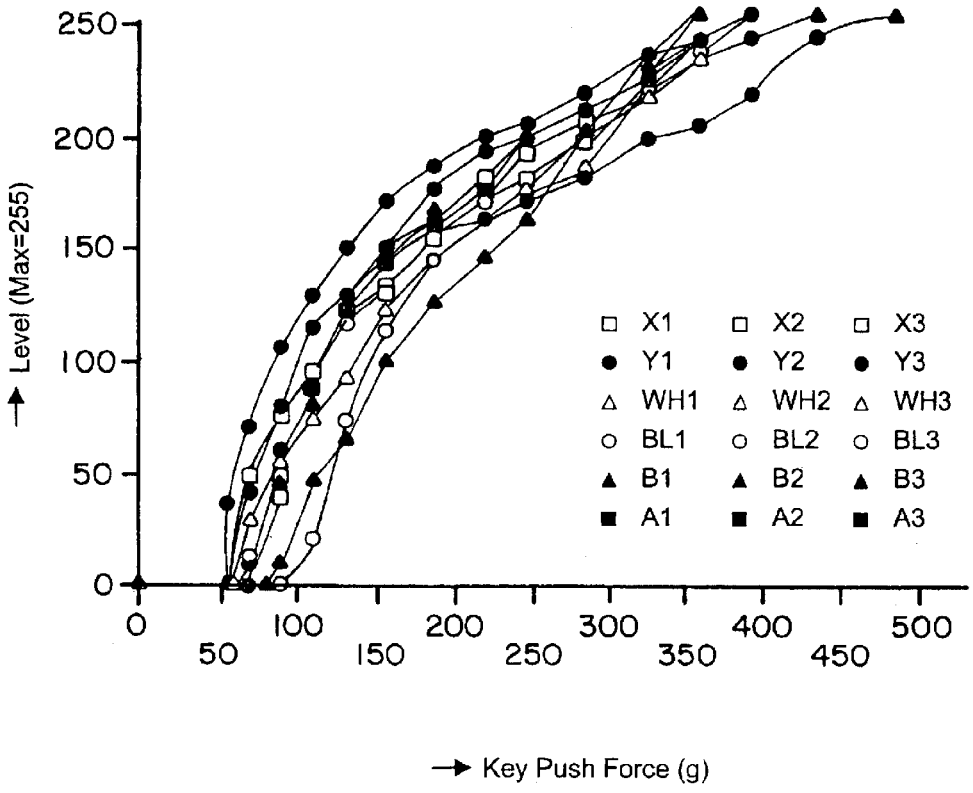
FIG. 5a PRIOR ART
FIG. 5(*a*) is a graph showing the relationship between downward force and output level for a fixed contact of FIG. 4 after two million operations.
Figure 5B:
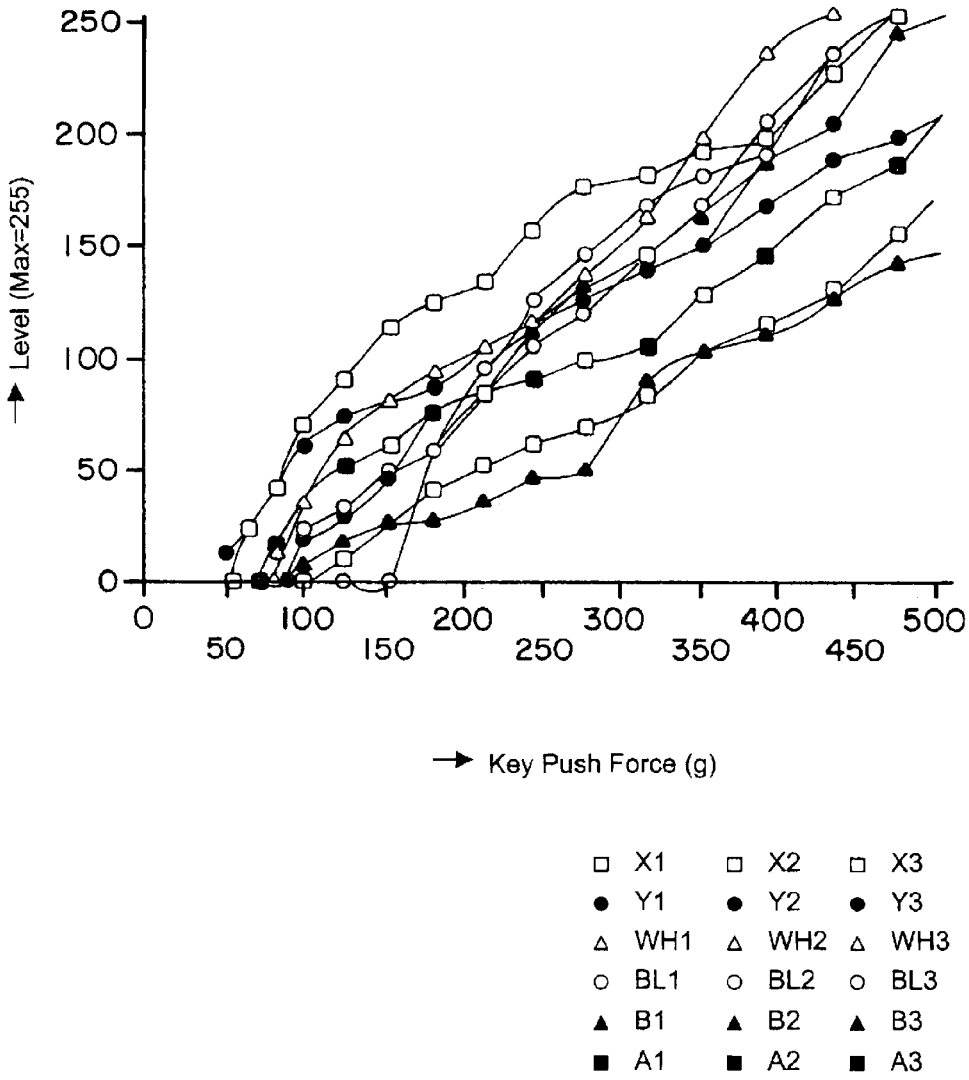
FIG. 5b PRIOR ART

FIG. 3 shows a fixed contact 35 according to an embodiment of the present invention. Fixed contact 35 has a structure that is approximately similar to the conventional fixed contact 1 shown in FIG. 4(*a*). However, the pattern pitch of the fixed contact 35 is changed to 0.5 mm from the 0.8 mm pattern pitch of the conventional fixed contact 1.

A terminal 36 is formed as a copper foil pattern 38 having an approximately E-shaped pattern disposed on a substrate 37. Terminal 36 is equipped with a plurality of contacts 36*a* and a contact connecting portion 36*b*. Carbon 39 is applied in an approximately E-shaped pattern onto copper foil pattern 38 to cover copper foil pattern 38. A terminal 40 is formed as a copper foil pattern 41 having an approximately reverse E-shaped pattern disposed on the substrate 37. Terminal 40 is equipped with a plurality of contacts 40*a* and a contact connecting portion 40*b*. Carbon 42 is applied in an approximately reverse E-shaped pattern onto copper foil pattern 41 to cover copper foil pattern 41. Contacts 36*a* of terminal 36 formed by copper foil pattern 38 and carbon 39 and contacts 40*a* of terminal 40 formed by copper foil pattern 41 and carbon 42 are arranged adjacent to each other in an alternating manner, and the pattern pitch of the alternating contacts 36*a*, 40*a* is 0.5 mm.

The contact mechanism that includes the fixed contact 35 has a narrower pattern pitch. Therefore, the possibility of misalignment of the contact position is reduced and the relationship between the downward force on the rubber piece and the output level of the contact mechanism is stable.

However, the copper foil patterns 38, 41 can damage the carbons 39, 42 after repeated operation of the contact mechanism using fixed contact 35. Therefore, the contact mechanism that uses fixed contact 35 is not sufficiently durable.

An optimal pattern pitch for the contacts 36*a*, 40*a* is 0.5 mm. However, the pattern pitch for the contacts 36*a*, 40*a* may range from 0.4 mm to 0.8 mm.

The contact mechanism comprises a fixed contact and a movable contact. The fixed contact is formed by arranging two terminals having a plurality of parallel contacts so that the contacts are disposed in an alternating manner and at a predetermined pattern pitch. The movable contact is disposed above the contacts of the fixed contact to be able to connect with the contacts of the fixed contact. The pattern pitch of the contacts is set within a range of 0.4 mm–0.8 mm. Therefore, the contact position can align correctly and the output level is stable.

The contacts of the fixed contact in the contact mechanism can be made of carbon formed on the substrate. The copper foil patterns used in conventional contact mechanisms are not used in the contacts. Therefore, damage to the carbon is reduced, the output level is stable, and the contact mechanism is durable.

The contacts of the fixed contact can be formed from carbon covering a copper foil pattern formed on the substrate. Therefore, the contact position can align correctly and the output level is stable.

Furthermore, the movable contact can be a pressure-sensitive element. Incorporating a pressure-sensitive element provides the additional advantage of the ability to vary the output level according to the amount of downward force applied to the contact mechanism.

Having described the preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A contact mechanism comprising:

a fixed contact member on a substrate, said fixed contact member comprising two terminals each comprising a contact connecting portion and a plurality of parallel contacts disposed in an alternating manner and at a predetermined pattern pitch ranging from 0.4 mm to 0.8 mm;

a movable contact member connectably disposed above said contacts of said fixed contact; and a cooper foil connecting section disposed on said substrate connecting each of the two terminals to the substrate, wherein the cooper foil connecting sections are only disposed under the contact connecting portion of the two terminals.

2. A contact mechanism as described in claim 1, wherein said contacts of said fixed contact member comprise carbon formed on said substrate.

3. A contact mechanism as described in claim 1, wherein said contacts of said fixed contact member comprise carbon covering a copper foil pattern connected to said copper foil connecting section formed on said substrate.

4. A contact mechanism as described in claim 1, wherein said movable contact member comprise a pressure-sensitive element.

5. A contact mechanism as described in claim 2, wherein said movable contact member comprise a pressure-sensitive element.

6. A contact mechanism as described in claim 3, wherein said movable contact member comprise a pressure-sensitive element.

* * * * *